US008776641B2

(12) United States Patent
Liau

(10) Patent No.: US 8,776,641 B2
(45) **Date of Patent: *Jul. 15, 2014**

(54) OPEN WRENCH

(76) Inventor: Jia-Guann Liau, Taichung (TW)

( * ) Notice: Subject to any disclaimer, the term of this patent is extended or adjusted under 35 U.S.C. 154(b) by 346 days.

This patent is subject to a terminal disclaimer.

(21) Appl. No.: 13/342,118

(22) Filed: Jan. 2, 2012

(65) Prior Publication Data

US 2013/0167692 A1 Jul. 4, 2013

(51) Int. Cl.
*B25B 13/08* (2006.01)

(52) U.S. Cl.
USPC ..... 81/119

(58) Field of Classification Search
USPC ..... 81/119, 125.1, 186, 121.1
See application file for complete search history.

(56) References Cited

U.S. PATENT DOCUMENTS

| | | | | | |
|---|---|---|---|---|---|
| 198,398 | A * | 12/1877 | Lester | ..... | 81/119 |
| 956,259 | A * | 4/1910 | Amborn | ..... | 81/119 |
| 2,161,163 | A * | 6/1939 | Hedgpeth | ..... | 81/119 |
| 2,619,862 | A * | 12/1952 | Trypanis | ..... | 81/119 |
| 8,443,701 | B1 * | 5/2013 | Liau | ..... | 81/119 |

* cited by examiner

*Primary Examiner* — Hadi Shakeri

(57) ABSTRACT

The present invention discloses an open wrench including handle and driving head connected thereto. The driving head has clamping opening and opening. The driving head has a stepped outer flat surface and an inner flat surface which is arranged in U shape and located along the clamping opening. The outer flat surface is higher than the handle. The inner flat surface is higher than the outer flat surface. The outer flat surface and inner flat surface have an included angle respectively.

11 Claims, 9 Drawing Sheets

OPEN WRENCH

FIELD OF THE INVENTION

The present invention relates to an open wrench, and more particularly, to an open wrench suitable for inserting into a narrow space to drive bolts.

BACKGROUND OF THE INVENTION

A conventional open wrench is disclosed in U.S. Pat. No. 2,687,056 and comprises a head connected to an end of the handle and the head has a mounting hole which is defined through the head and an opening communicates with the front end of the head and the mounting hole. The top and bottom flat surfaces each have an inclined surface which is located around the mounting hole and the lowest area of the inclined surface is the at the opening so that the front end of the head is thin enough for convenience of inserting into a narrow space. As shown in FIG. 13, the head 40 of the conventional open wrench has an inclined surface which extends to the flat front end of the head 40. When the height of the opening of the front end has a standard height H1 which provides sufficient strength, however, the thickness of the head 40 at a small distance along the inclined surface becomes H4 which is so thick that requires much material and the head 40 will be too big to be inserted into the narrow space.

The present invention intends to provide an open wrench that can be inserted into a narrow space while the strength is maintained.

SUMMARY OF THE INVENTION

The present invention relates to an open wrench and comprises a handle having a first driving head connected thereto and the first driving head includes a clamping opening and an opening which communicates with the clamping opening so as to be mounted onto a hexagonal cylindrical head of an object. The first driving head comprises two second flat portions which are located on the top and the bottom of the first driving head, each of the two second flat portions has a stepped outer flat surface and an inner flat surface which is arranged in U shape and located along the clamping opening. The outer flat surface is a U-shaped surface and located along the inner flat surface. The outer flat surface is higher than the handle, and the inner flat surface is higher than the outer flat surface. A first included angle defined between the outer flat surface and the horizontal surface is between 0.5 to 2.5 degrees. The distal end of the outer flat surface located close to the opening is located closest to the horizontal surface. A second included angle N2 defined between the inner flat surface and the horizontal surface is between 1 to 3 degrees. The distal end of the inner flat surface located close to the opening is located closest to the horizontal surface. The second included angle is larger than that of the first included angle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
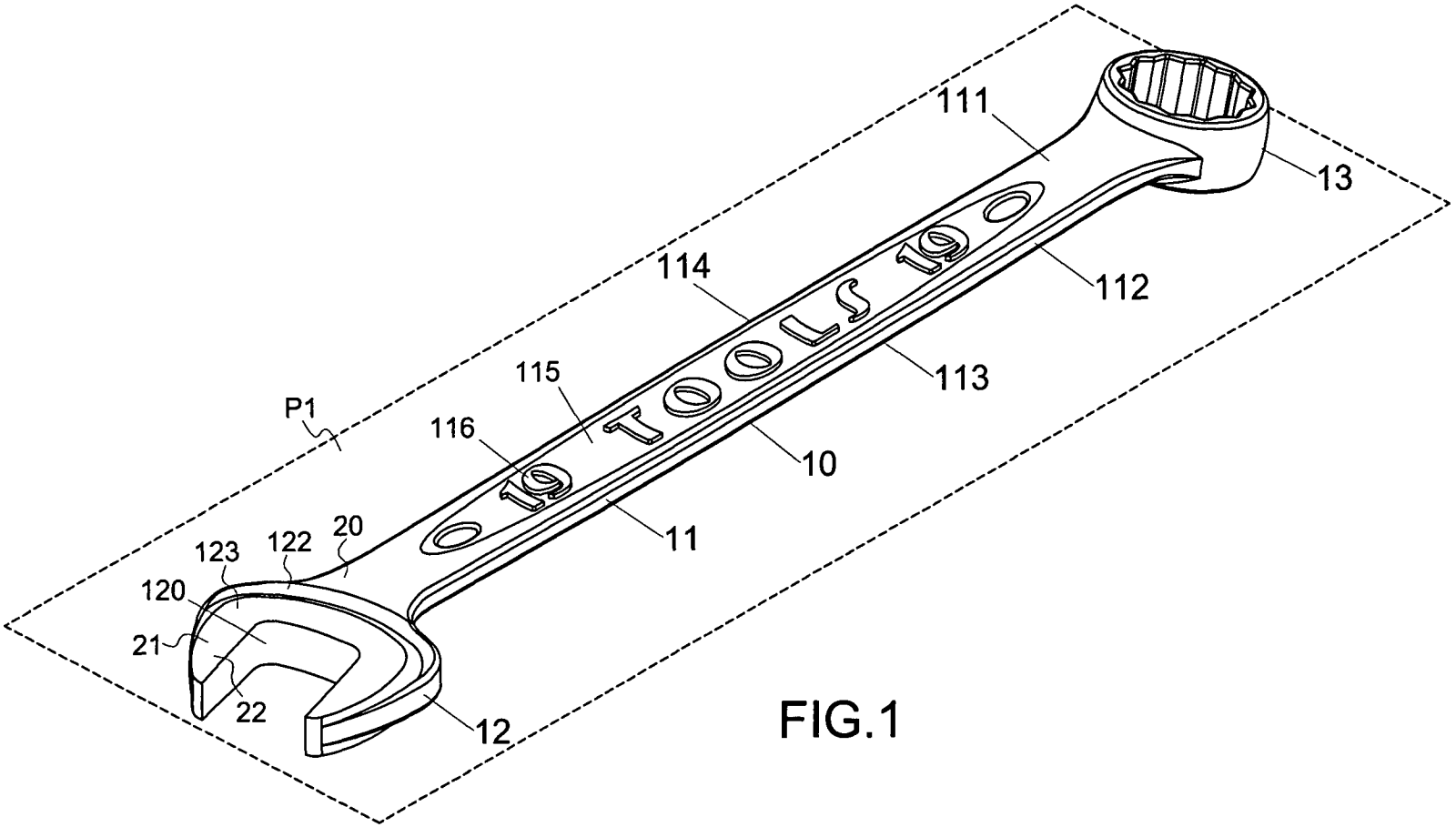
FIG. 1 is a perspective view to show the open wrench of the present invention.
Figure 2:
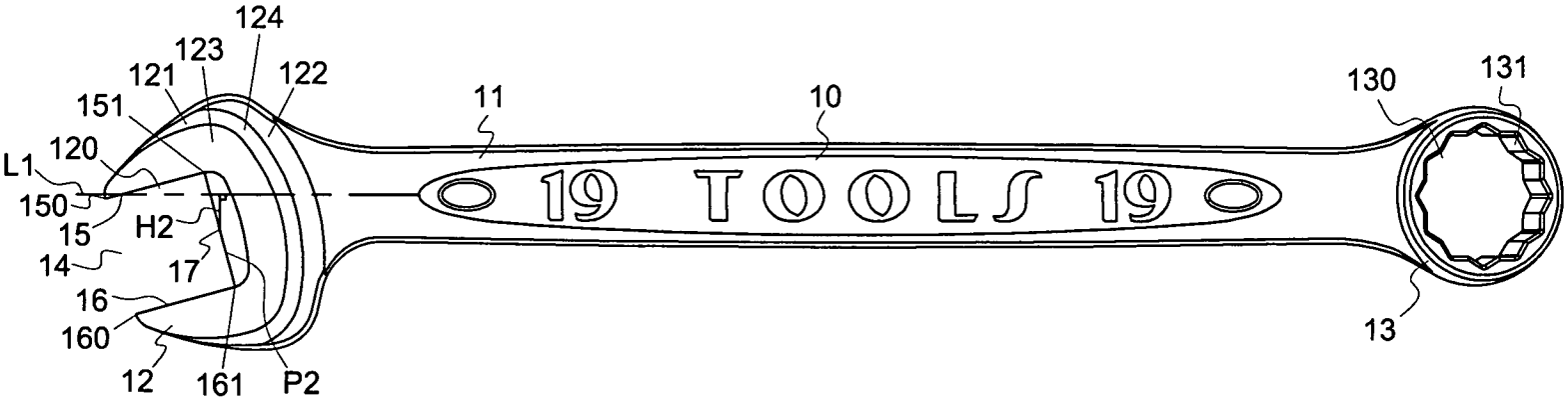
FIG. 2 is the top view of the open wrench of the present invention.

Referring to FIG. 1, the open wrench 10 of the present invention comprises a handle 11 which is a flat and elongate handle relative to the horizontal surface P1, and has a first driving head 12 connected to the first end of the handle 11. The handle 11 includes two first flat portions 111, 113 respectively located on the top and the bottom thereof. Two sides 112, 114 are located on two sides of the handle 11. At least one first flat portion 111 has a recessed area 115 in which a display portion 116 is located. The top of the display portion 116 is in flush with or higher than the first flat portion 111. The display portion 116 can be text contents, patterns, specifications, sizes or logos. The first driving head 12 has a clamping opening 120 which is used to be mounted onto a hexagonal cylindrical head 31 of an object. The axis of the clamping opening 120 is perpendicular to the horizontal surface P1. The first driving head further has an opening 14 located at the front end of the first driving head 12 and communicates with the clamping opening 120. The first driving head 12 has two second flat portions 121 which are located on the top and the bottom of the first driving head 12. Each of the two second flat portions 121 has a stepped outer flat surface 122 and an inner flat surface 123 which are arranged in U shape and located along the clamping opening 120. The outer flat surface 122 is a U-shaped surface and located along the inner flat surface 123. The outer flat surface 122 is higher than the handle 11, and the inner flat surface 123 is higher than the outer flat surface 122. A first included angle N1 such as 0.8 degrees, is defined between the outer flat surface 122 and the horizontal surface P1 and is between 0.5 to 2.5 degrees. The distal end of the outer flat surface 122 located close to the opening 14 is located closest to the horizontal surface P1. A second included angle N2 such as 1.945 degrees, is defined between the inner flat surface 123 and the horizontal surface P1 and is between 1 to 3 degrees. The distal end of the inner flat surface 123 located close to the opening 14 is located closest to the horizontal surface P1. The minimum axial length H1 of the clamping opening 120 is located at the opening 14 and equal to the height of the hexagonal cylindrical head 31. The second included angle N2 is larger than that of the first included angle N1

A curved surface 124 is connected between the inner flat surface 123 and the outer flat surface 122. The clamping opening 120 has two parallel clamping surfaces 15,16 and each of the two clamping surfaces 15, 16 has a first end face 150/160 and a second end face 151/161. The first end face 150/160 extends to the opening 14. The second end face 151/161 is located on a common vertical surface P2. A middle point 17 located between the two second end faces 151, 161 of the two clamping surfaces 15, 16 is located on the vertical surface P2. The minimum distance from the middle point 17 to the central axis L1 of the handle 11 is a shift distance H2 which is between 2 mm to 7 mm. An included angle between the two clamping surfaces 15, 16 and the central axis L1 is 15 degrees.

Figure 3:
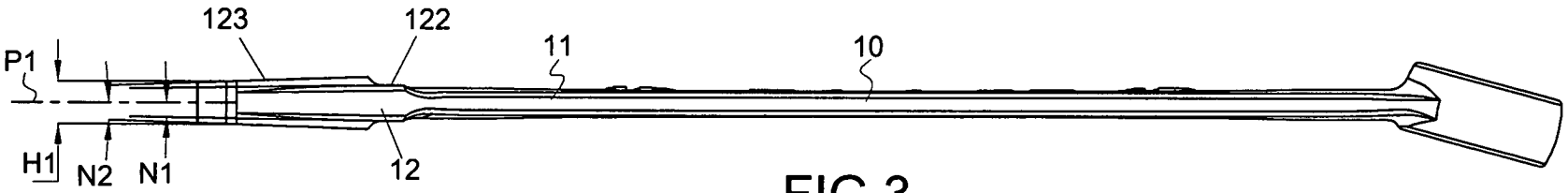
FIG. 3 is the side view of the open wrench of the present invention.
Figure 4:
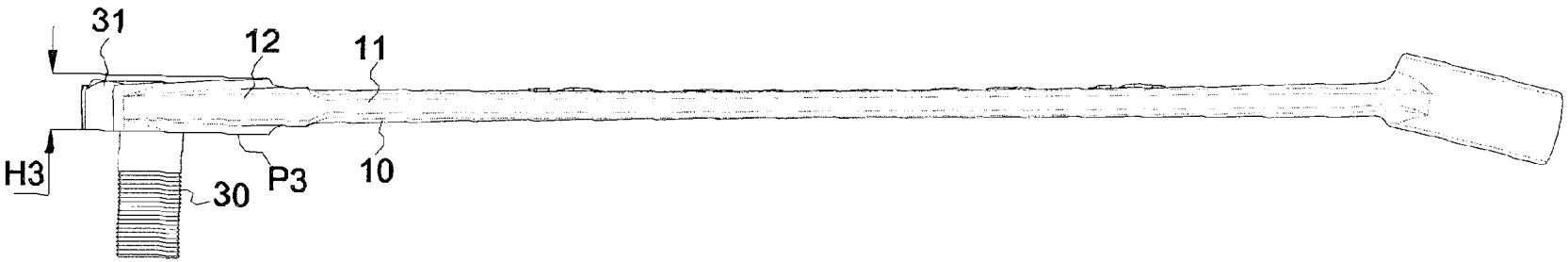
FIG. 4 shows that the open wrench of the present invention rotates an object.
Figure 5:
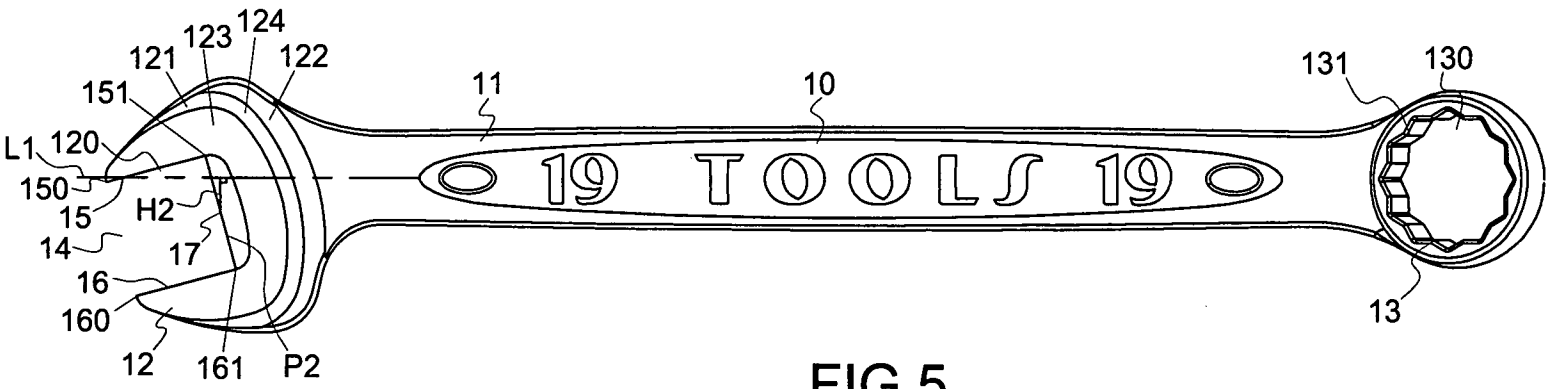
FIG. 5 is the top view of the second embodiment of the open wrench of the present invention.
Figure 6:
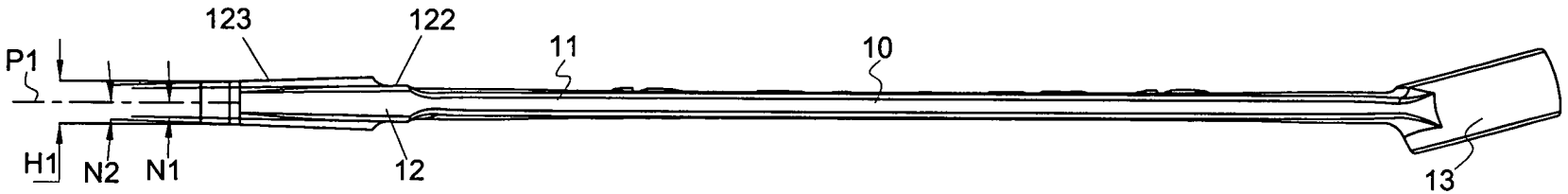
FIG. 6 is the side view of the second embodiment of the open wrench of the present invention.
Figure 13:
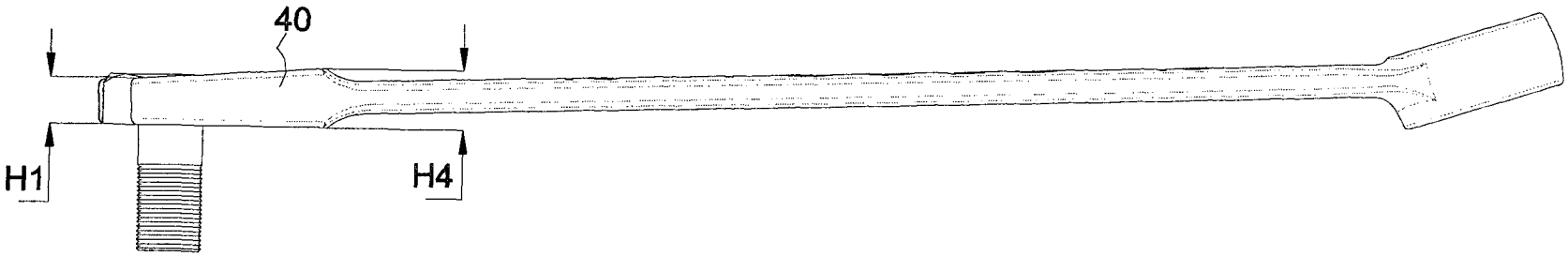
PRIOR ART FIG13
FIG. 13 is a perspective view of the conventional open wrench.

As shown in FIGS. 3 and 4, when the clamping hole 120 is used to be mounted to a head 31 of a bolt 30, the inner flat surface 123 of the second flat portion 121 on the rear side is in flush with the surface P3, and handle 11 is inclined upward relative to the bolt 30 so that the user can easily hold the handle 11. The maximum distance H3 of the inner flat surface 123 inclined relative to the surface P3 is slightly larger than the height of the head 31 of the bolt 30 and smaller than the maximum height H4 of the conventional open wrench as shown in FIG. 13. The height of the first driving head 12 of the present invention is smaller so as to be easily inserted into a narrow space. Furthermore, the present invention includes the shift distance H2 so that the required width for the wrench to drive is small and not impeded by other objects.

Figure 7:
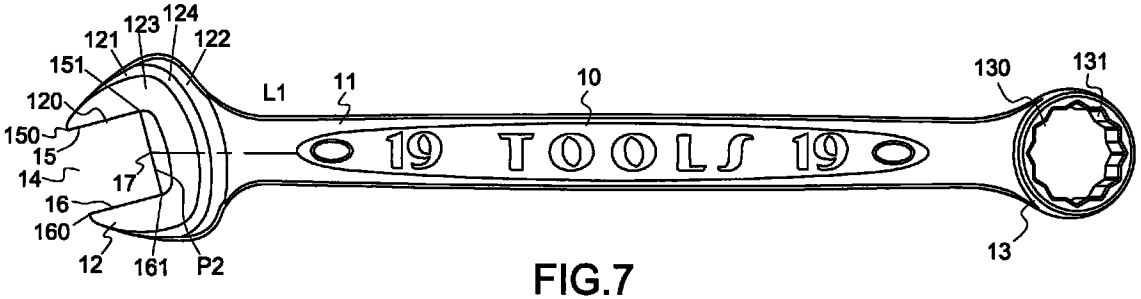
FIG. 7 is the top view of the third embodiment of the open wrench of the present invention.
Figure 8:
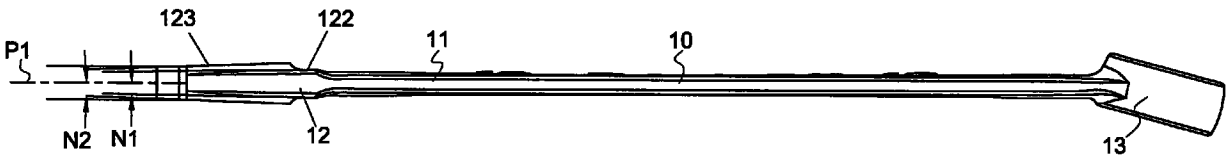
FIG. 8 is the side view of the third embodiment of the open wrench of the present invention.

As shown in FIGS. 7 and 8, which show another embodiment, the middle point 17 located between the two second end faces 151, 161 of the two clamping surfaces 15, 16 is located on the central axis L1.

Figure 9:
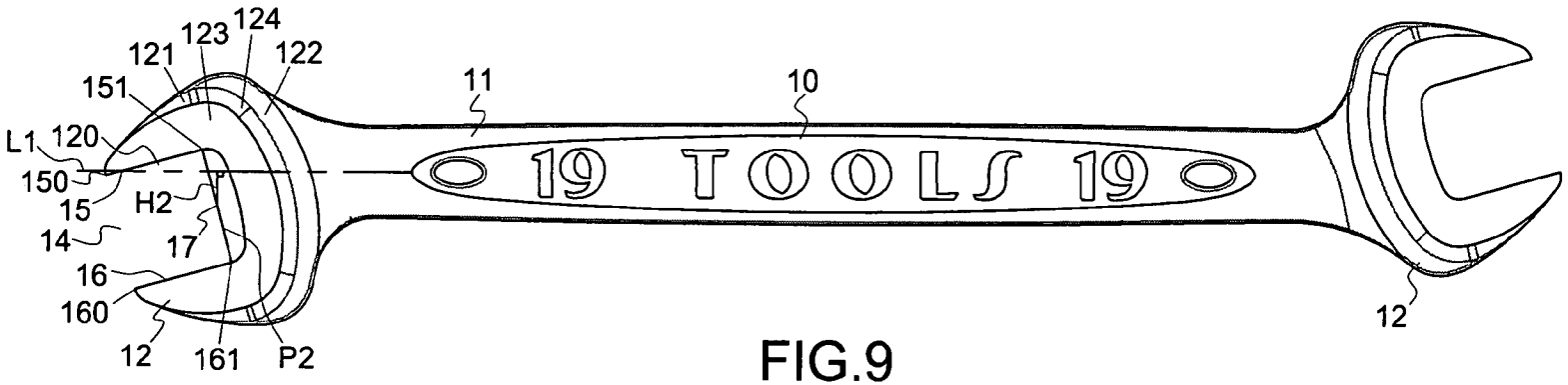
FIG. 9 is the top view of the fourth embodiment of the open wrench of the present invention.
Figure 10:
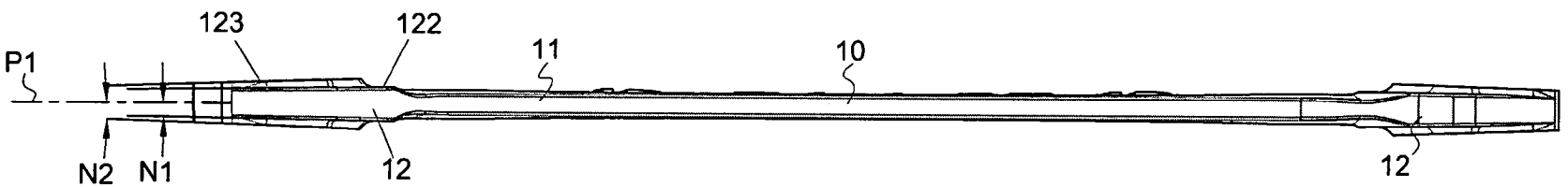
FIG. 10 is the side view of the fourth embodiment of the open wrench of the present invention.
Figure 11:
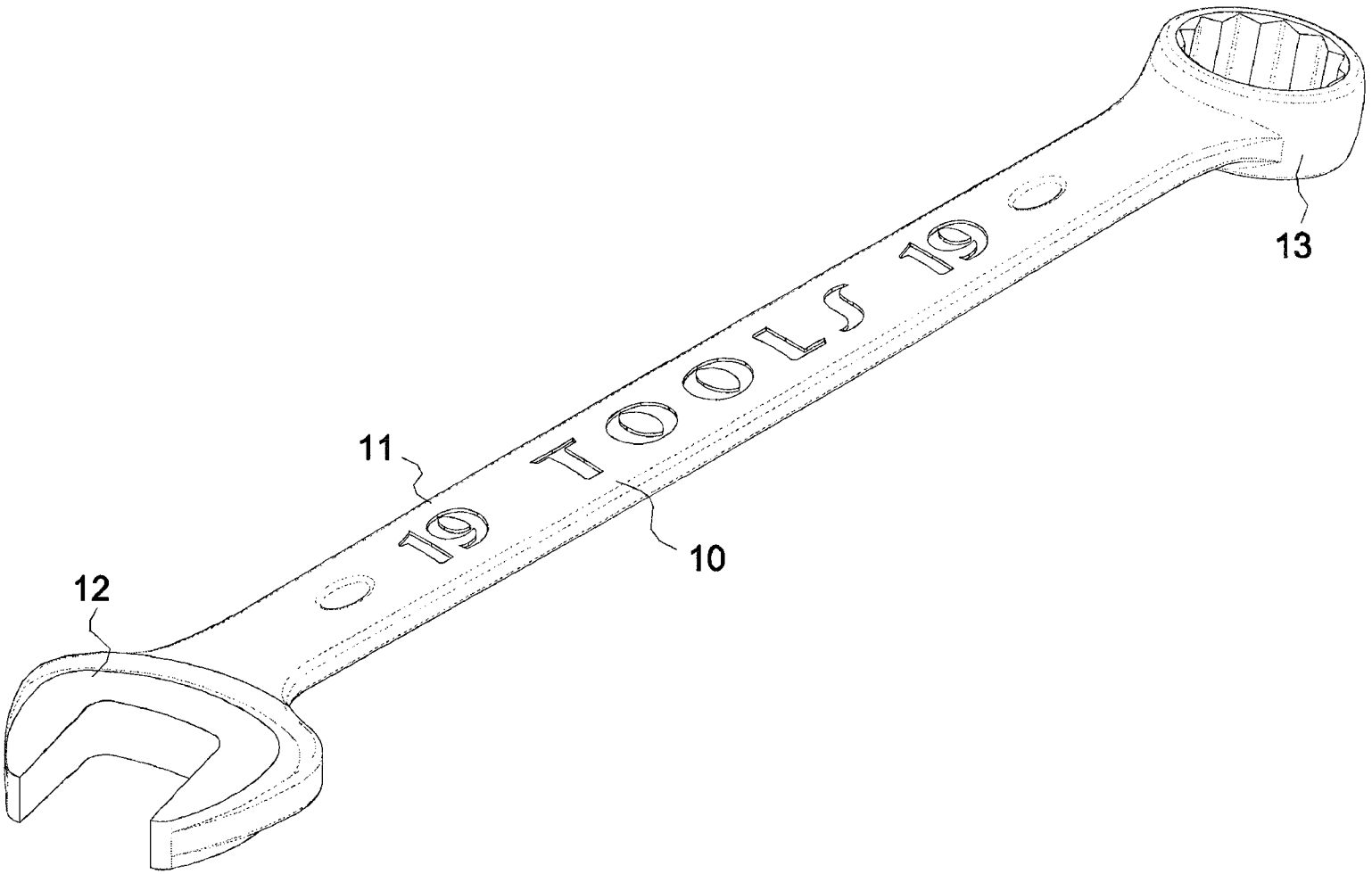
FIG. 11 is a perspective view of the fifth embodiment of the open wrench of the present invention.
Figure 12:
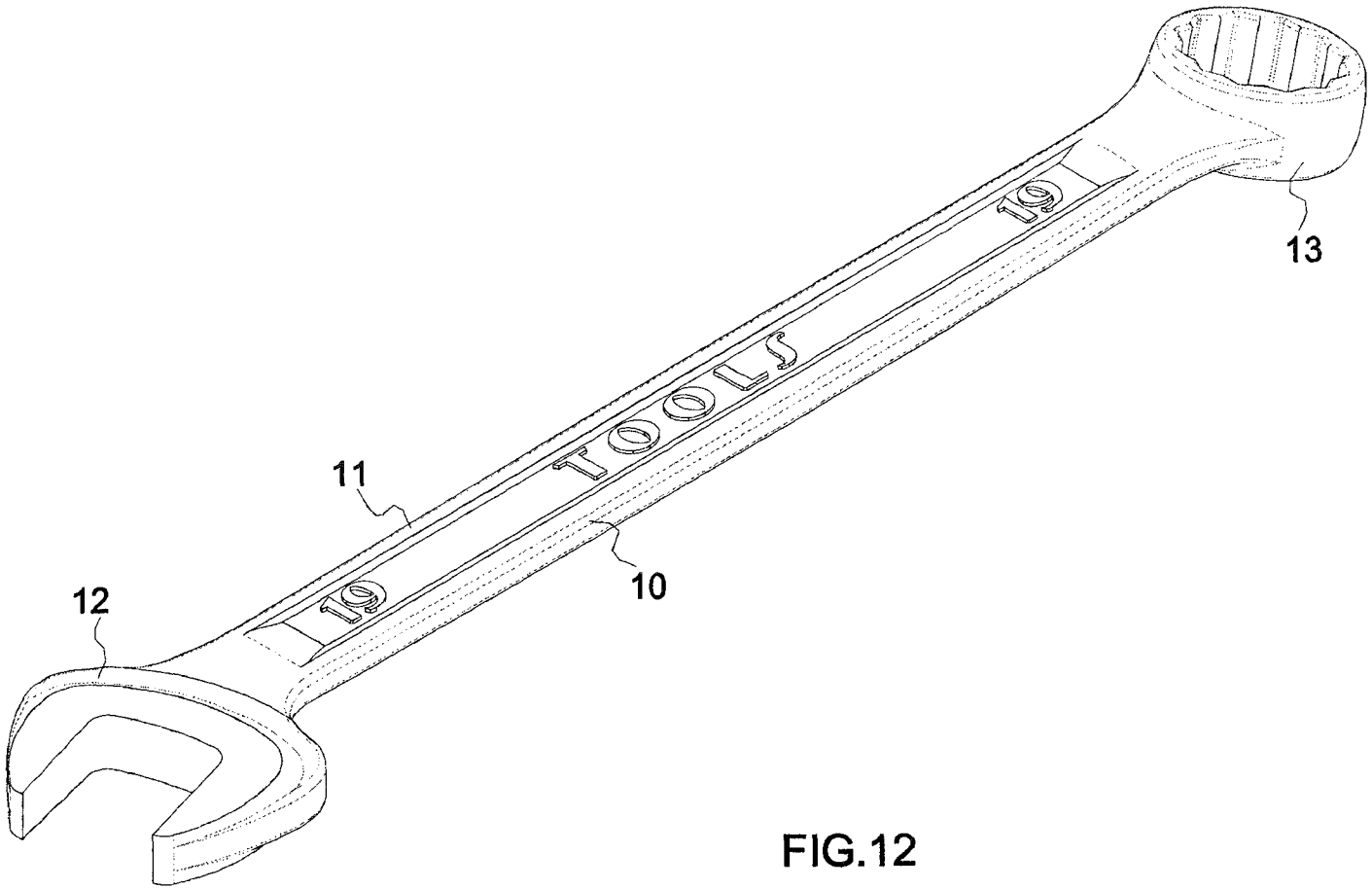
FIG. 12 is a perspective view of the sixth embodiment of the open wrench of the present invention.

As shown in FIGS. 9 and 10, the handle 11 has two driving heads 12 respectively located on two ends thereof and each driving head 12 has an opening 14. FIGS. 11 and 12 respectively show two different handles 11.

In the embodiment as shown in FIG. 1, a first coated layer 20 is coated to the surface of the open wrench and a portion of the first coated layer 20 at the inner flat surface 123 is then removed to form a blank portion 21. A second coated layer 22 is coated to the inner flat surface 123 and coated over the blank portion 21. The first and second coated layers 20, 22 have different colors.

While we have shown and described the embodiment in accordance with the present invention, it should be clear to those skilled in the art that further embodiments may be made without departing from the scope of the present invention.

What is claimed is:

1. An open wrench comprising a handle and a first driving head, a rear end of the first driving head being connected to a first end of the handle, the first driving head having a clamping opening and an opening which communicates with the clamping opening so as to be mounted onto a hexagonal cylindrical head of an object, an axis of the clamping opening being perpendicular to a horizontal surface, the opening being located at the front end of the first driving head; wherein, the first driving head having two second flat portions which are located on a top and a bottom of the first driving head, each of the two second flat portions having a stepped outer flat surface and an inner flat surface which is arranged in U shape and located along the clamping opening, the outer flat surface being a U-shaped surface and located along the inner flat surface, the outer flat surface being higher than the handle, the inner flat surface being higher than the outer flat surface, a first included angle defined between the outer flat surface and the horizontal surface being between 0.5 to 2.5 degrees, a distal end of the outer flat surface located close to the opening being located closest to the horizontal surface, a second included angle defined between the inner flat surface and the horizontal surface being between 1 to 3 degrees, a distal end of the inner flat surface located close to the opening being located closest to the horizontal surface, the second included angle being larger than that of the first included angle.

2. The open wrench as claimed in claim 1, wherein the first included angle is 0.8 degrees.

3. The open wrench as claimed in claim 1, wherein the second included angle is 1.945 degrees.

4. The open wrench as claimed in claim 1, wherein the handle has a second driving head connected to a second end thereof and the second driving head has an enclosed mounting hole which has multiple protrusions extending inward from an inner periphery thereof.

5. The open wrench as claimed in claim 4, wherein the second driving head is bent by an angle relative to the horizontal surface.

6. The open wrench as claimed in claim 1, wherein a curved surface is connected between the inner flat surface and the outer flat surface.

7. The open wrench as claimed in claim 1, wherein the clamping opening has two parallel clamping surfaces and each of the two clamping surfaces has a first end face and a second end face, the first end face extends to the opening, the second end face are located on a common vertical surface, a middle point located between the two second end faces of the two clamping surfaces is located on the vertical surface, a minimum distance from the middle point to a central axis of the handle is a shift distance which is between 2 mm to 7 mm, an included angle between the two clamping surfaces and the central axis is 15 degrees.

8. The open wrench as claimed in claim 7, wherein the shift distance is 5 mm.

9. The open wrench as claimed in claim 1, wherein the handle includes two first flat portions respectively located on a top and a bottom thereof, two sides are located on two sides of the handle, at least the first flat portion has a recessed area in which a display portion is located.

10. The open wrench as claimed in claim 9, wherein a top of the display portion is in flush with or higher than the first flat portion.

11. The open wrench as claimed in claim 1, wherein the open wrench is with a first and a second coated layers having different colors.

* * * * *